United States Patent [19]

Jagst et al.

[11] Patent Number: 4,798,516

[45] Date of Patent: Jan. 17, 1989

[54] BLOWER-CONVEYOR FOR TEXTILE FIBER TUFTS IN A CLEANING LINE AND METHOD

[75] Inventors: Peter Jagst, Monchen-Gladbach; Axel Thannheiser, Hof/S.-Moschendorf, both of Fed. Rep. of Germany

[73] Assignee: Trützschler GmbH & Co. KG, Monchen-Gladbach, Fed. Rep. of Germany

[21] Appl. No.: 887,058

[22] Filed: Jul. 18, 1986

Related U.S. Application Data

[63] Continuation-in-part of Ser. No. 641,257, Aug. 16, 1984, abandoned.

[30] Foreign Application Priority Data

Aug. 20, 1983 [DE] Fed. Rep. of Germany ..... 3330199

[51] Int. Cl.[4] ..... F04D 29/00; B07B 7/06

[52] U.S. Cl. ..... 415/121 A; 415/168; 406/171; 209/321

[58] Field of Search ..... 415/121 A, 121 G, 168, 415/127, 166, 208; 209/394, 321, 250, 261; 19/200, 85, 90, 97.5; 34/57 E; 406/52, 171, 173

[56] References Cited

U.S. PATENT DOCUMENTS

| | | | |
|---|---|---|---|
| 845,044 | 2/1907 | Baldwin | 415/168 X |
| 1,221,500 | 4/1917 | Anderson | 415/166 |
| 2,813,306 | 11/1957 | Sheldon | 19/90 |
| 3,055,500 | 9/1962 | Avbert-Maguero | 209/384 |
| 3,320,640 | 5/1967 | Van Doorn | 19/97.5 |
| 3,523,743 | 8/1970 | Jolette | 415/208 |
| 4,047,912 | 9/1977 | Markland | 415/168 X |
| 4,175,893 | 11/1979 | Vollrath et al. | 406/52 |
| 4,251,356 | 2/1981 | Harte | 209/250 |
| 4,403,374 | 9/1983 | Wood | 406/171 X |
| 4,426,753 | 1/1984 | Oellers et al. | 19/85 X |
| 4,441,262 | 4/1984 | Gazzoni | 34/57 E X |

FOREIGN PATENT DOCUMENTS

| | | | |
|---|---|---|---|
| 900173 | 6/1945 | France | 415/121 G |
| 2 | 1/1878 | United Kingdom | 19/89 |
| 24674 | 10/1909 | United Kingdom | 19/90 |

*Primary Examiner*—Robert E. Garrett
*Assistant Examiner*—Joseph M. Pitko
*Attorney, Agent, or Firm*—Spencer & Frank

[57] ABSTRACT

A fiber processing line is formed of a plurality of fiber processing machines connected by a conveyor duct. A blower-conveyor is arranged for driving fiber tufts in an air stream through the conveyor duct. The blower-conveyor includes a discharge housing, a rotary impeller supported in the discharge housing; an inlet opening in the discharge housing for drawing the fiber material into the blower axially with respect to the impeller. The discharge housing includes a housing wall generally circumferentially surrounding the impeller and bounding a blower outlet which, similarly to the inlet, is connected to the duct. A waste separator is integrated in the blower-conveyor. The waste separator includes throughgoing openings in the housing wall for providing passages for waste from the fiber tufts upstream of the outlet opening as viewed in a direction of advance of the fiber tufts. The openings are sized to be sufficiently large to allow passage therethrough of waste larger than dust particles and sufficiently small to prevent passage of fiber tufts therethrough.

6 Claims, 4 Drawing Sheets

BLOWER-CONVEYOR FOR TEXTILE FIBER TUFTS IN A CLEANING LINE AND METHOD

This is a continuation-in-part of application Ser. No. 641,257 filed Aug. 16, 1984.

BACKGROUND OF THE INVENTION

This invention relates to a blower for pneumatically advancing textile fiber tufts and is of the type which has an inlet opening through which the material passes axially, an impeller and a discharge housing having a wall, generally circumferentially surrounding the impeller and guiding the material driven by the impeller. The blower-conveyor forms part of a multi-machine fiber cleaning line in a system for spinning preparation and functions as a pneumatic conveyor for driving the fiber tufts in an air stream through the machines which are serially connected to one another by a conveyor duct.

In conventional blowers of fiber processing lines pitted or abraded inner surface areas may be found, caused essentially by hard waste, such as trash or sand mixed with the fiber material. Such waste is significantly accelerated by the centrifugal force of the impeller and thus impinges with substantial force on inner housing wall surfaces. In fiber processing lines such blower-conveyors have been used exclusively for advancing the fiber tufts and there have been no structural provisions, integrated with the blower construction, for eliminating such waste from blowers of this type.

SUMMARY OF THE INVENTION

It is an object of the invention to provide an improved blower-conveyor which forms part of a fiber processing line and in which waste from the fiber material is removed to thus avoid the above-discussed disadvantages.

This object and others to become apparent as the specification progresses, are accomplished by the invention, according to which, briefly stated, a waste separating arrangement is integrated in the blower-conveyor. The arrangement includes throughgoing openings in the housing wall for providing passages for waste from the fiber tufts upstream of the outlet opening as viewed in a direction of advance of the fiber tufts. The openings are sized to be sufficiently large to allow passage therethrough of waste larger than dust particles and sufficiently small to prevent passage of fiber tufts therethrough.

The centrifugal force of the rotor throws the fiber tufts at least in part over the wall surface which is provided with openings thus causing the waste to leave the outlet housing through the openings. The fiber tufts leave the blower through the blower outlet. It is a particular advantage of the blower according to the invention that a cleaning station is provided therein which operates on the electric power available for the blower motor and thus a separate cleaning station with additional electric power requirements may be dispensed with.

According to a preferred embodiment of the invention, the generally circumferential housing wall is formed at least in part as a grid constituted by grid bars. The fiber material impinges on the grid bar edges or on the grid bar faces which are oriented towards the rotor, whereby impurities are separated which leave through the grid slots defined by adjoining grid bars. In this manner the centrifugal energy of the impeller is combined with the effect of the grid bars. Preferably, on that side of the circumferential housing wall which is oriented away from the impeller, a dead space for collecting the waste is provided in which the air passing through the grid slots is calmed so that the waste is not reintroduced into the inner space of the blower through the grate gaps by undesired air streams. Expediently, between the openings of the housing wall and the waste collecting chamber a sealing slide element is provided for arbitrarily varying the effective surface of the openings or the grid.

According to an advantageous feature of the invention, upstream of the inlet opening of the blower a settable guide element (deflector) is provided for setting the direction of the fiber inflow. In this manner, the fiber may be positively directed against the openings.

DESCRIPTION OF THE PREFERRED EMBODIMENTS

Figure 1:
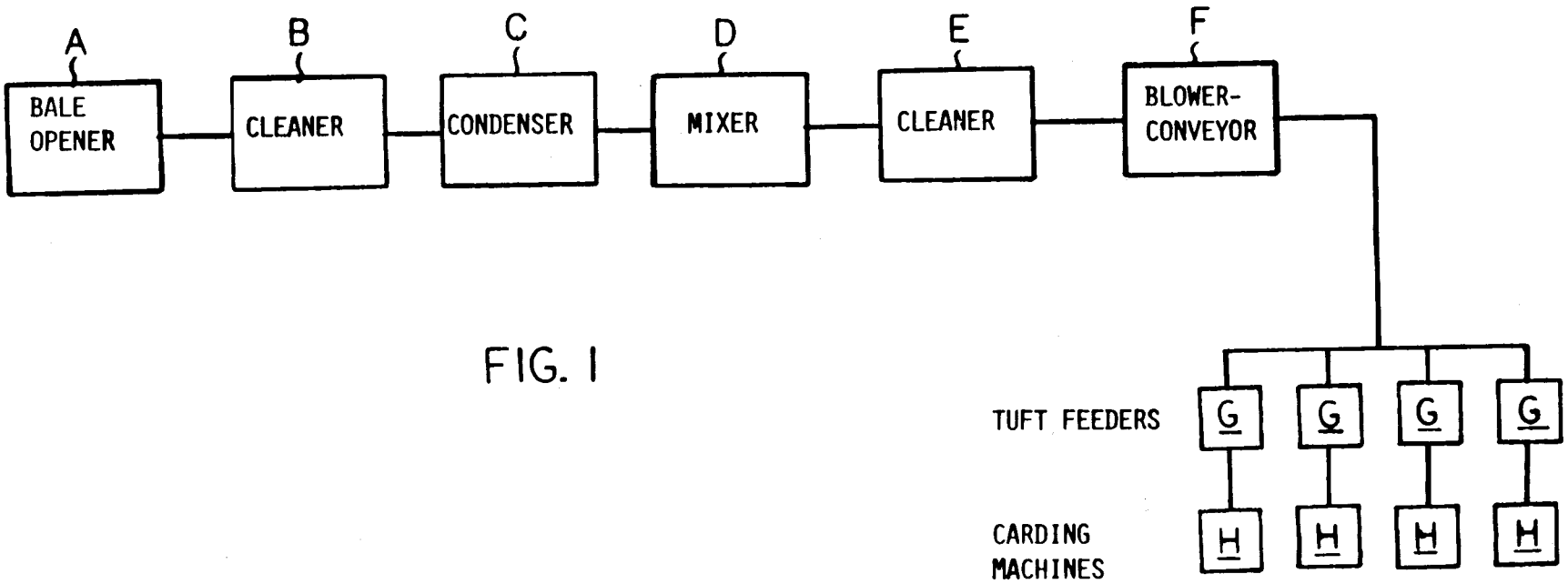
FIG. 1 is a block diagram of a fiber tuft processing line, incorporating the invention.

Turning to FIG. 1, there is illustrated a block diagram of a fiber tuft processing line as part of a system for preparing the fiber material for spinning. In the given, simplified example, the first machine of the fiber processing line is a bale opener A which detaches fiber tufts from fiber bales. The consecutive downstream machines whose output in each instance is connected to the input of the immediately downstream arranged equipment, are a cleaner B, a condenser C, a mixer D, a cleaner E, parallel-arranged tuft feeders G, each of which supplies a separate carding machine H which, in turn, produces a sliver deposited in coiler cans (not shown). The fiber tuft is conveyed in the processing line by an air stream which is generated by a blower-conveyor F constructed according to the invention. In this example, only a single blower conveyor is shown: it is arranged between the output of the beater E and the inputs of the parallel-arranged tuft feeders G. It is to be understood that the particular location of the blower-conveyor F in the processing line and the quantity thereof used in the processing line may vary. The connecting lines between the individual machines A through G symbolize the pneumatic duct in which the fiber material is conveyed by the airstream generated by the blower-conveyor F.

Figure 2:
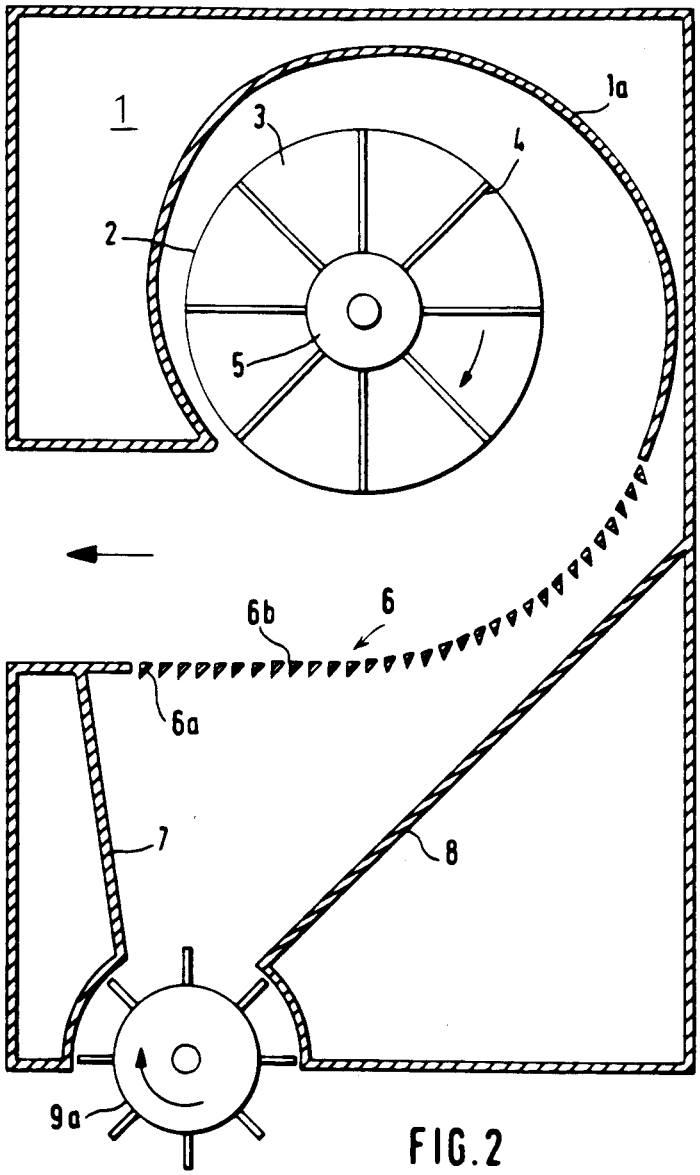
FIG. 2 is a schematic sectional elevational view of a preferred embodiment of the invention.

Turning to FIG. 2, the blower-conveyor shown therein has an outlet housing 1 including a spiral housing wall 1*a* generally circumferentially surrounding an impeller 2 in a spaced relationship therewith. The impeller 2 is formed essentially of a planar carrier disc 3, axially and radially extending vanes 4 and a carrier ring 5. The impeller 2 has an rpm of approximately 1500 up to a maximum 3000. The housing wall 1*a* is, at least in part, formed as a grid 6 composed of grid bars 6*a* between which there are defined grid slots 6*b* extending parallel to the axis of the impeller 2.

The grid slots 6*b* have a width in the range of 7 to 12 mm which is sufficiently large to permit waste material, particularly hard waste, such as trash to pass through and thus be eliminated from the conveyor stream. The given range for the slot width 6b is, however, sufficiently small to prevent the light, not trash-laden fiber tufts from passing through.

Thus, the invention unifies in a single construction a pneumatic conveyor for driving fiber tufts in an air stream in a fiber processing line and a trash separator. The latter thus utilizes the centrifugal forces generated for the material conveyance and consequently, a separate trash removal equipment which would need its own energy input may be dispensed with.

Underneath the grid 6 there are provided guide baffles 7 and 8 which guide the downwardly exiting waste to a compartmentalized dispenser wheel 9a which seals the space underneath the grid 6 and which removes the impurities from that space.

Figure 3:
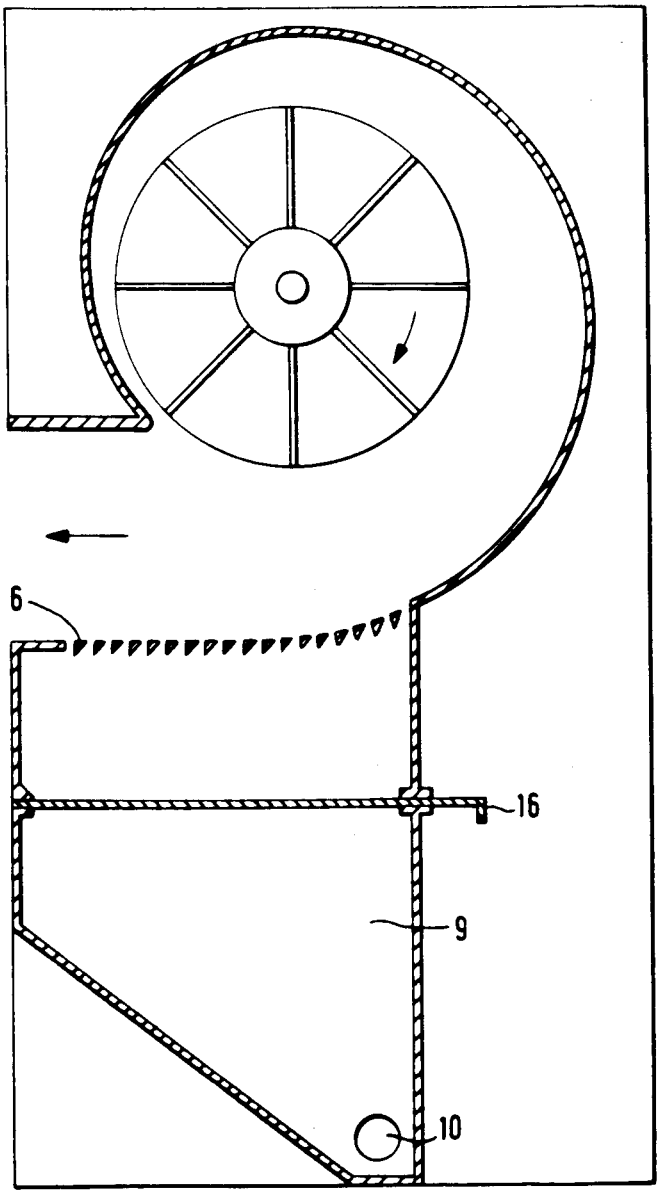
FIG. 3 is a schematic sectional elevational view of a further preferred embodiment of the invention.

Turning now to FIG. 3, underneath the grid 6 there is provided a waste collecting dead space 9 which is under vacuum by means of a vacuum conduit 10. Underneath the grid 6 there is situated a sealing slide element such as a shiftable sheet metal plate 16.

Figure 4:
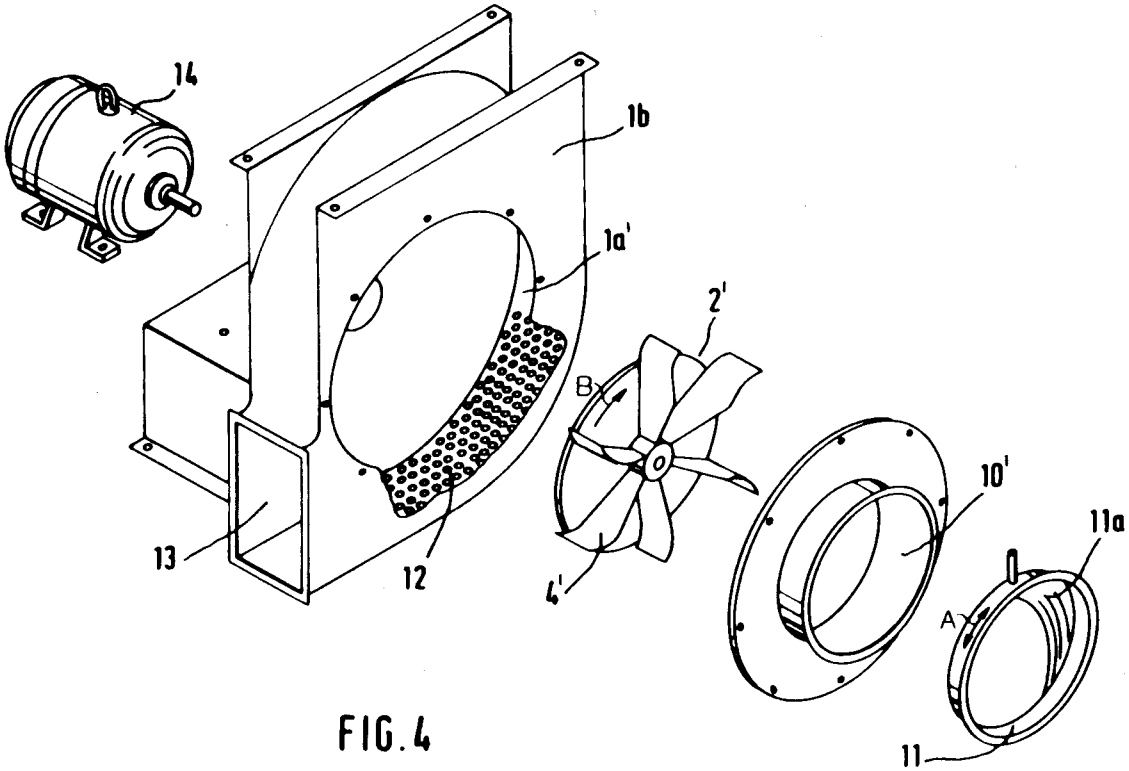
FIG. 4 is an exploded perspective view of still another preferred embodiment of the invention.

Turning now to FIG. 4, the textile fiber material (not shown) such as cotton fiber tufts, enters the blower through the axial inlet opening 10'. Upstream of the inlet opening 10' a guide element (inlet deflector) 11 is provided which may be settable in the direction of the double-headed arrow A and which comprises a ring which has a routing face 11a covering one part of its inner face. The routing face 11a is bent in the direction of the inlet opening 10'. The fiber material impinges on the impeller 2' and is entrained in the direction of the arrow B by the vanes 4'. During this motion, the fiber material is, together with the impurities, thrown in part against the housing wall 1a' in a radial direction whereby heavy impurities leave through the openings, such as holes 12. The diameter of the openings 12, similarly to the width of the slots 6b of the earlier-described embodiments, is designed to be less than the size of the fiber tufts. The fiber tufts leave the inner space of the blower through the outlet opening 13 and are introduced into the duct leading to the tuft feeders H (FIG. 1). The impeller 2' is driven by a motor 14. The lateral walls of the blower housing are designated at 1b.

It will be understood that the above description of the present invention is susceptible to various modifications, changes and adaptations, and the same are intended to be comprehended within the meaning and range of equivalents of the appended claims.

What is claimed is:

1. In a fiber processing line formed of a plurality of fiber processing machines connected by a conveyor duct, a blower-conveyor arranged for driving fiber tufts in an air stream through said conveyor duct; the blower-conveyor including a discharge housing, a rotary impeller supported in said discharge housing; means defining an inlet opening in the discharge housing for drawing the fiber material into the blower axially with respect to said impeller; said inlet opening being connected to said duct; said discharge housing including a housing wall generally circumferentially surrounding the impeller and bounding a blower outlet connected to said duct; the improvement comprising waste separating means integrated in said blower-conveyor; said waste separating means including throughgoing openings in said housing wall for providing passages for waste from the fiber tufts upstream of the outlet opening as viewed in a direction of advance of the fiber tufts; said openings being sized to be sufficiently large to allow passage therethrough of waste larger than dust particles and sufficiently small to prevent passage of fiber tufts therethrough.

2. A blower as defined in claim 1, wherein said waste separating means comprises a grid including grid bars spaced from one another at a distance of approximately 7–12 mm.

3. A blower as defined in claim 1, further comprising means defining a waste collecting chamber on a side of said housing wall oriented away from said impeller; said waste collecting chamber being bounded by the throughgoing openings.

4. A blower as defined in claim 3, further comprising a sealing slide element supported in said waste collecting space adjacent said throughgoing openings.

5. A blower as defined in claim 1, further comprising a settable deflector means situated at said inlet opening for controlling the direction in which the fiber material is drawn into the blower through said inlet opening.

6. In a method of pneumatically conveying fiber tufts in a conveyor duct consecutively connecting to one another a plurality of fiber processing machines, including the step of generating an air stream by an impeller of a blower-conveyor having a low pressure side and a high pressure side connected to said duct, whereby the air stream and the fiber tufts therein pass through said blower-conveyor; the improvement comprising the step of separating waste from the air stream within the blower-conveyor by centrifugal forces applied to the waste by the impeller; the step of separating waste including the step of passing the waste through openings in a curved discharge housing accommodating the impeller; the openings being sized to be sufficiently large to allow passage therethrough of waste larger than dust particles and sufficiently small to prevent passage of fiber tufts therethrough.

* * * * *